United States Patent [19]

Dulac

[11] Patent Number: 4,477,248

[45] Date of Patent: Oct. 16, 1984

[54] OIL BURNER SHUTTER

[76] Inventor: Robert R. Dulac, 111 Golder Rd., Lewiston, Me. 04240

[21] Appl. No.: 520,335

[22] Filed: Aug. 4, 1983

[51] Int. Cl.[3] ..... F23D 11/36

[52] U.S. Cl. ..... 431/153; 110/185; 122/23; 126/285 R; 431/154

[58] Field of Search ..... 110/185, 187, 188, 190, 110/186; 122/4 R, 10, 14, 15, 22, 23, 503; 126/285 R, 285 A, 285 B; 431/153, 154, 155

[56] References Cited

U.S. PATENT DOCUMENTS

| | | | |
|---|---|---|---|
| 2,758,637 | 8/1956 | Bergtholdt et al. | 431/153 |
| 3,169,571 | 2/1965 | Madsen | 431/153 |
| 3,498,323 | 3/1970 | Rahm | 431/154 |
| 3,606,610 | 9/1971 | Leach | 431/153 |
| 4,253,404 | 3/1981 | Leonard | 110/188 |

*Primary Examiner*—Edward G. Favors
*Assistant Examiner*—Steven E. Warner
*Attorney, Agent, or Firm*—William Nitkin

[57] ABSTRACT

An oil burner shutter to block off an oil burner from a wood/coal boiler when not in use having a movable shutter with an aperture therein and means to move said shutter to an open or closed position including means to operate said shutter automatically in conjunction with said oil burner and the boiler's aquastat and damper.

5 Claims, 4 Drawing Figures

OIL BURNER SHUTTER

BACKGROUND OF THE INVENTION

1. Field of the Invention

The apparatus of this invention resides in the area of combination oil/wood and coal-burning boilers, and more particularly relates to an improved shutter mechanism to seal the oil burner aperture into an oil/wood/-coal-burning boiler when the oil burner is not in use.

2. History of the Prior Art

Many woodburning boilers utilize, in conjunction with their ability to burn wood, an auxiliary oil burner. The oil burner may be used during times when one is unable to load wood into the boiler or whenever one wishes to burn oil. It is important to protect the oil burner and its nozzle from the woodburning flames and heat when the oil burner is not being utilized. A closure device must be utilized which effectively seals off the oil burner from the combustion chamber of the boiler when the oil burner is not in use. Of course, the oil burner must not be sealed off while it is operating otherwise a fire could result. One device now on the market utilized to accomplish the closure of the oil burner when not in use from the combustion chamber consists of a semicircular plate which is rotatably attached at one end to a shaft adapted so that when the shaft is rotated by an electric motor, the plate is moved in and out of the way of the oil burner in an aperture between the oil burner and the boiler's combustion chamber. One problem which arises in using such a device is that it is not air-tight and many woodburning boilers, in order to achieve their high-degree of efficiency and control, must be completely sealed air-tight. Another problem is that combustion deposits tend to fall to the base of the chamber containing the rotating plate and often prevent the plate from completing its downward rotation to block the aperture in the side of the boiler through which the oil burner's nozzle shoots its flame. The failure to close this aperture completely allows heat from the burning of the wood possibly to cause damage to the oil burner nozzle and further allows unwanted air circulation in the combustion chamber thereby decreasing the control and efficiency of the wood burning boiler.

SUMMARY OF THE INVENTION

It is an object of this invention to provide an improved shutter mechanism to effectively seal air-tight the combustion chamber of a woodburning boiler from its auxiliary oil burner. The device also acts to support the oil burner at its entry aperture on the boiler. The boiler is equipped with a plurality of bolt members affixed to its outer case around the oil burner aperture. In woodburning boilers of the type having a water jacket the sides of the water jacket around the oil burner aperture are sealed. Many of the woodburning oil burners utilize an air entry vent in another portion of the boiler which has a damper member controlled by a motor which will either open the damper member or completely close it depending on the temperature in the system. A mounting base having apertures therein with a mounting base aperture defined therein is positioned so that its mounting bolt apertures fit onto the mounting bolts protruding from the boiler so that the mounting base aperture aligns with the oil burner aperture in the side of the boiler. On the outer face of the mounting base are protruding side edges and a like protruding portion around the mounting base aperture. These protruding portions act as a scraper to clean any deposits off the inner face of the shutter member. The shutter member is a substantially rectangular planar member having a dual shoulder at its top and a shutter aperture defined therein. The shutter member is of a length so that in one mode the shutter aperture can be aligned with the mounting base aperture and when moved horizontally another section of the shutter can totally block the mounting base aperture. The shutter member rides within a track in a mounting bracket against the mounting base. The mounting bracket is affixed to the mounting base and extends outward having its collar portion affixed to a flange portion which receives the oil burner, holding the air tube thereof in front of the shutter. A linear actuator, attached to the mounting base and with its arm attached to the shutter, drives the shutter to either an open or closed position. A pair of switches located on the mounting bracket are positioned so that they will be struck by the shoulders on the shutter at various points in its travel so as to control the linear actuator motor and the oil burner as will be described in further detail below. Located in the mounting bracket are ball members which are urged by springs to press the shutter member against the mounting base to assist in forming an air-tight seal so that when the shutter member is in a closed position, it seals the combustion chamber of the boiler air-tight. When the oil burner is to be used, the shutter is moved laterally so that its aperture aligns with the mounting base aperture and the oil burner aperture in the side of the boiler and the oil burner can then operate.

DESCRIPTION OF THE PREFERRED EMBODIMENT(S)

Figure 1:
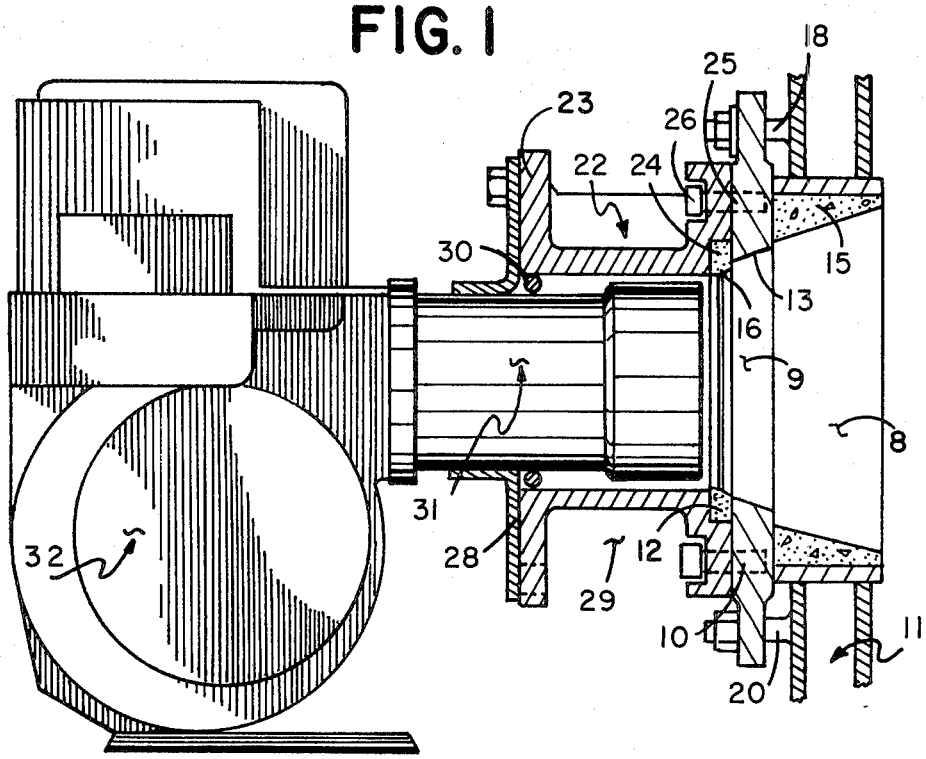
FIG. 1 illustrates a side sectional view of the device of this invention.

FIG. 1 is an elevational cross-sectional view of the device of this invention. Seen in this view is furnace wall 11 which is of the water jacket type. Mounting bolts, such as bolts 18 and 20 seen from the side extend outward from the exterior of the furnace wall around oil burner aperture 8. In a preferred embodiment there may be four mounting bolts. The sides of oil burner aperture 8 are bevelled inwardly by being filled with a refractory cast cement liner 15. Affixed to mounting bolts 18 and 20 is mounting base 10 which can be held by nuts to the mounting bolts as shown. Mounting base aperture 9 defined in mounting base 10 is aligned with oil burner aperture 8 and the sides of mounting base aperture 9 also have an inward bevel 13. The front face of mounting base 10 seen in FIG. 3 also includes protrusions 58 and 60 at each side thereof and a protrusion 56 around the mounting base aperture 9. Seen in FIG. 1, held against mounting base 10, is shutter 12 which in this figure has its shutter aligned with mounting base aperture 9. The sides of shutter aperture 14 are also formed in an inward bevel 16. The bevels of the shutter aperture, mounting base aperture and oil burner aperture in the furnace wall substantially form a cone to assist in the combustion process and to help prevent deposits from forming on these elements as the flame of the burner blasts thereby. Mounting bracket 22 is attached to the mounting base by bolts, such as bolt 26 threaded into receipt aperture 25, and has formed therein a horizontally disposed shutter slot 24 in which shutter 12 is laterally adapted to move and which in selected positions can either open or seal the oil burner from the interior of the boiler. Mounting bracket 22 extends outward to retaining collar 23 on which is attached mounting flange 28 which has an adjustable diameter for receipt of air tube 31 of oil burner 32 which is inserted into its receipt aperture in the mounting bracket so that its front is adjacent to the shutter 12. An asbestos cord seal 30 can be wrapped around air tube 31 and the entire burner 32 is securely held by the tightening of the mounting flange 28 thereagainst holding it in position in mounting bracket 22. At the bottom of mounting bracket 22 is defined a space 29 in which is positioned a portion of linear actuator 34. Linear actuator 34 which can be of a type such as Warner Electric ACB-10PB is affixed to mounting base 10 and has an actuator shaft 36 bolted by bolt 39 to a shutter interconect member 38 which is attached to the shutter. When the linear actuator is operated, the push-pull stroke of actuator shaft 36 moves shutter 12 back and forth either exposing or closing the mounting base aperture 9 and oil burner aperture 8.

Figure 2:
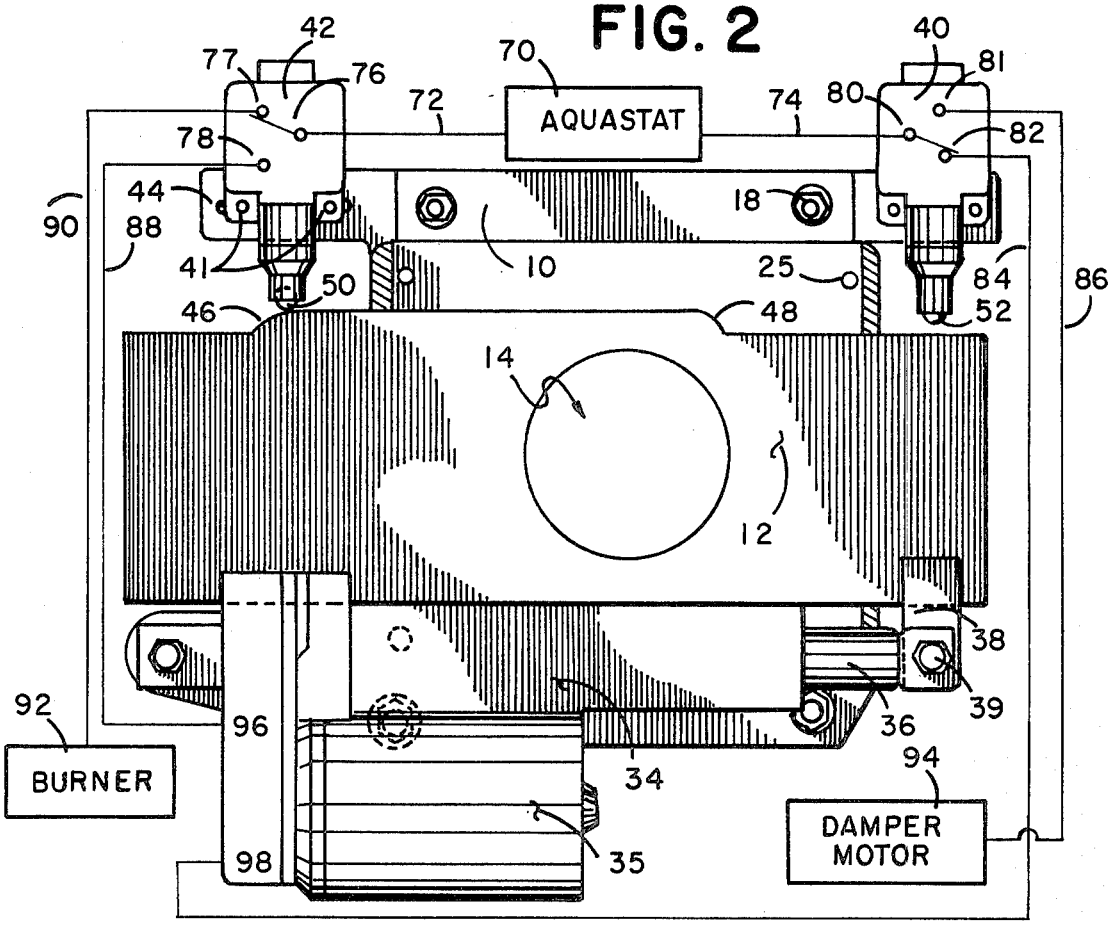
FIG. 2 illustrates a front view of the invention with the mounting bracket and oil burner removed for a direct view of the shutter.

In FIG. 2 the mounting bracket 22 and attached burner 32 are not shown and one can directly see shutter 12 over mounting base 10. At the top of mounting base 10 are positioned a first single-pole double-throw switch 40 and a second single-pole double-throw switch 42 which is adapted to be adjustable laterally by movement after loosening its attachment screws 41 in adjustment bracket 44. These switches are actuated by the lateral movement of the shoulders of shutter 12 which, for example, would pass first shoulder 48 under ball contact 52 of the first switch 40, thereby pushing element 52 upwards and changing the current path through the switch. At the same time that this is happening, second shoulder 46 moves away from ball contact 50 of second switch 42, allowing the contact to move downward thereby changing the current path in second switch 42. The linear actuator is run by an attached electric motor 35 and in the embodiment shown in FIG. 2 second switch 42 is shown with its ball contact member 50 being depressed while shutter aperture 14 is aligned with the other apertures into the boiler, allowing current to run to the oil burner for operation as will be described below. In this position also, first switch 40 is shown in an extended position.

In operation the switches receive current directed by a switch within the aquastat 70 of the boiler. An aquastat such as Honeywell 6006 can be used. If set at a temperature of 160 degrees F., upon a decrease in temperature, line 72 from the aquastat will provide power to the switching element 76 of switch 42 and at the same time it will provide no power through line 74 to the switching element 80 of switch 40. If the temperature should increase though, the aquastat will cease providing current to line 72 and will provide current to line 74. Should the temperature of the water in the boiler increase to cause the aquastat to switch the current to line 74, switching element 80 will be engaged to contact 82 due to the extended position of ball contact member 52 as there is no shoulder thereunder. This would direct current through line 84 to linear actuator contact 98 of the linear actuator motor 35 which would actuate the movement of arm 36 moving shutter 12 to the right so as to block the aperture to the boiler. At the same time current through line 72 from the aquastat would cease and would shut down burner 92 as no current would be carried thereto through line 90. As the shutter 12 moved to the right shoulder 48 would engage ball contact 52 causing the switch element 80 to be moved from contact 82 to contact 81 thereby directing current through line 86 to damper motor 94 and ceasing to direct current to contact 82 and through line 84 to linear actuator contact 98. When the temperature of the water in the boiler drops below a set degree, for example 160 degrees F., the power to line 74 will be switched off by aquastat 70 thereby shutting down the damper motor and the power would then run to line 72. At this point because shutter 12 is in its closed position to the right, ball contact member 50 of switch 42 is in an extended position causing current to pass from switching element 76 to contact 78 and then through line 88 to contact 96 of the actuator motor 35. This will cause the actuator motor to start in the reverse direction, moving the shutter to the left until its aperture is aligned with the apertures into the boiler at which point shoulder 46 will have raised ball contact member 50 causing the switching of the current from line 72 to pass from contact 76 to 77 and through line 90 to turn on the oil burner 92 and ceasing to direct current to contact 78 and through line 88 to linear actuator contact 96. In this way the shutter operates automatically in conjunction with the burner, damper motor, and aquastat. In this diagram the common currents and grounds to the burner, damper motor and linear actuator as well as the switching elements within the aquastat are not illustrated since these are well-known in the art.

Figure 3:
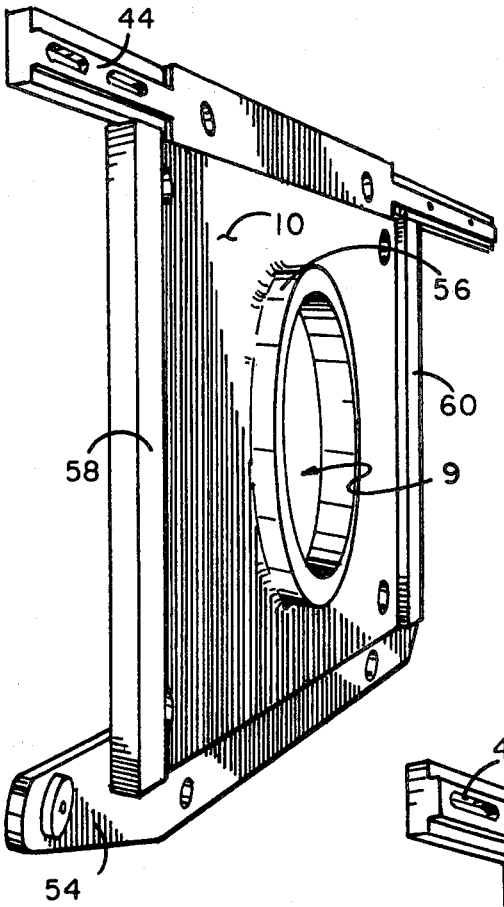
FIG. 3 illustrates a perspective view of the mounting base.

FIG. 3 illustrates linear actuator mounting arm 54 which is a part of mounting base 10. Seen in this view are raised sections 56, 58 and 60 on the face of the mounting base which serve to act as a scraper as shutter 12 moves back and forth thereagainst to scrape off any deposits that may form on the side of the shutter moving against mounting base 10 which deposit removal helps prevent jamming that might otherwise occur if the shutter was allowed to have deposits remain thereon and was moved against a large flat surface.

Figure 4:
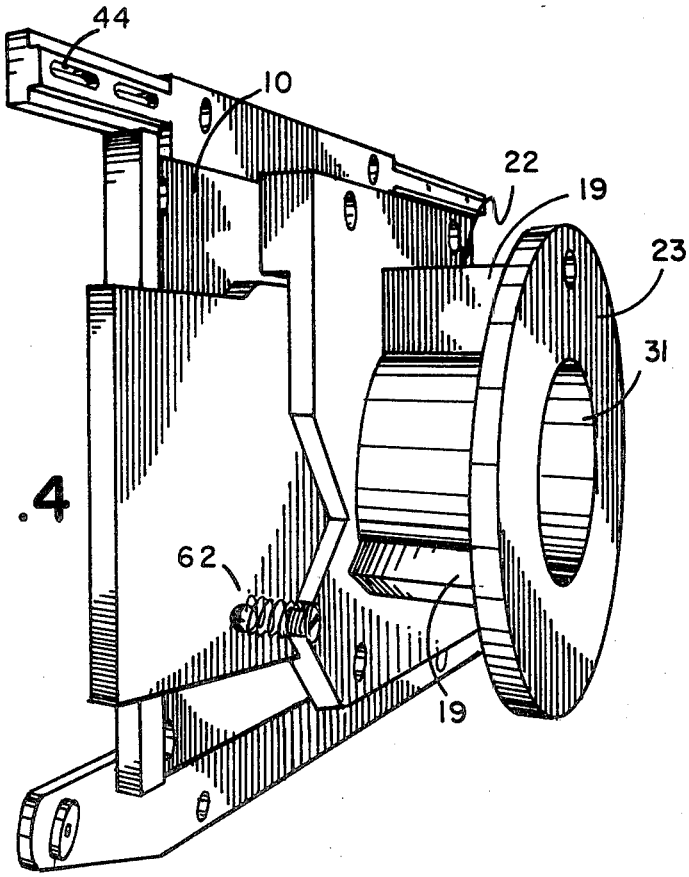
FIG. 4 illustrates a perspective expanded view of the mounting bracket, shutter and mounting base.

FIG. 4 illustrates a view showing mounting bracket 22 extending out to retaining collar 23. Seen in this view are reinforcement members 19 which strengthen the mounting bracket so that it is sufficiently strong to hold the burner structure and also seen in a cutaway portion are ball members 62 forced by springs against shutter 12 holding it tightly against mounting base 10 so as to cause an air-tight seal therebetween when the shutter is in a closed position. More than one ball member can be utilized in various positions in the mounting bracket to press against the shutter at various points yet still allow it to move laterally.

Although the present invention has been described with reference to particular embodiments, it will be apparent to those skilled in the art that variations and modifications can be substituted therefor without departing from the principles and spirit of the invention.

I claim:

1. A device of the type to close an opening defined in a boiler through which an oil burner fires, said oil burner being electrically operated and of the type having an air tube, comprising:

means for support of said device positioned around said opening;

a mounting base having an aperture defined therein aligned with said opening and means to retain said mounting base to said boiler by said means for support;

a mounting bracket adapted to be retained on said mounting base, said mounting bracket further having an aperture defined therein aligned with said opening in said boiler, means to retain said oil burner in alignment with said opening in said aperture in said mounting bracket and a shutter slot horizontally defined therein adjacent to said mounting base;

a substantially rectangular shutter member adapted to be movably positioned in said shutter slot having an aperture defined in a portion thereof which in an operation mode is alignable with said opening and which in a non-operation mode is horizontally moved away from said opening which is then blocked by another portion of said shutter, said shutter adapted in its non-operation mode to seal the opening in said boiler;

means to move said shutter from said position in its operation mode to its position in its non-operation mode and vice versa;

a mounting flange attached to said mounting bracket and surrounding said oil burner's air tube to hold said oil burner in said device entirely on the opposite side of said shutter from said opening in said boiler; and means adapted to be operated by said shutter during movement thereof at predetermined times to turn on said oil burner when said shutter is in an operation mode with said aperture aligned with said opening in said boiler and to turn off said oil burner when said shutter is in a non-operation mode with said opening in said boiler sealed by a portion of said shutter.

2. The device of claim 1 further including a raised portion on said mounting base on a section thereof facing said shutter, said raised portion adapted to scrape against said shutter.

3. The device of claim 1 wherein said means to turn said oil burner on or off comprises:

a first and a second raised shoulder portion of said shutter spaced apart from one another on said shutter;

a first and a second single-pole double-throw switch member, each positioned on said mounting base, adapted to be pushed alternately by said first and second shoulder portions, said first switch adapted to be pushed when said shutter is in its operation mode and not to be pushed when said shutter is in its non-operation mode and said second switch adapted to be pushed when said shutter is in its nonoperation mode and not to be pushed when said shutter is in its operation mode, said first switch member adapted to be switched to a first mode when pushed by said first shoulder portion when said shutter is in its operation mode and said first switch switched to a second mode when not pushed by said first shoulder when said shutter is in its non-operation mode, said second switch member adapted to be switched to a first mode when pushed by said second shoulder portion when said shutter is in its operation mode and said second switch switched to its second mode when not pushed by said second shoulder portion when said shutter has moved said second shoulder away from said second switch in its non-operation mode;

means for measuring the temperature within said boiler, said temperature measuring means including switch means to direct current to said first switch member upon a decrease in temperature in said boiler and upon an increase of temperature in said boiler to stop directing current to said first switch member and to direct said current to said second switch member;

a damper in said boiler;

a damper motor activating said damper to draw air into said boiler;

said first switch, when current is supplied to said switch from said temperature measuring means, in its first mode is adapted to supply electric current to said oil burner to operate said oil burner, and said first switch in its second mode is adapted to cease supplying electric current to said oil burner causing it to cease operation and to supply current to operate said means to move said shutter;

said second switch, when current is supplied to said switch from said temperature measuring means, in its first mode is adapted to supply electric current to said damper motor to operate said damper and said second switch in its second mode is adapted to cease supplying current to said damper motor causing said damper to cease to operate and to direct current to operate said means to move said shutter;

whereby when said shutter is in an open position and when said temperature is decreased in said boiler and said means for sensing temperature directs current to said first switch, when said first switch is in its first mode, said first switch directs current to said burner; and upon the increase of temperature in said boiler, said means for sensing temperature then ceases to direct current through said first switch to said burner, shutting off said burner, and said means for sensing temperature directs current to said second switch which then is in its second mode and said second switch directs current to said means to move said shutter causing said shutter to move into its non-operation position and close over said aperture while said second shoulder then pushes said second switch to its first mode causing said first switch to cease directing current to said means to move said shutter and to then direct current to operate said damper motor, while upon the decrease in temperature in said boiler said means for sensing temperature ceases directing current to said second switch and directs said current to said first switch which is in its second mode, no longer pushed by said first shoulder, causing said current to be directed to said means to move said shutter thereby moving said shutter to its operation position to align its aperture with said opening in said boiler and causing said first shoulder to activate said first switch to its first mode that ceases directing current to said means to move said shutter and which first switch then directs said current to said oil burner, said oil burner then firing through said apertures in said shutter, said mounting bracket and mounting base then all said apertures being aligned, into said boiler.

4. The device of claim 3 wherein said means to move said shutter is an electrically-operated linear actuator having a movable arm, said linear actuator attached at one end thereof to said mounting base and attached at its movable arm attached to said shutter.

5. The device of claim 4 further including a raised portion on said mounting base on a section thereof facing said shutter adapted to scrape against said shutter.

* * * * *